US005924919A

United States Patent [19]

Hirano

[11] Patent Number: 5,924,919

[45] Date of Patent: Jul. 20, 1999

[54] COIN DISPENSER

[75] Inventor: Yasuo Hirano, Tokyo, Japan

[73] Assignee: Aruze Corporation, Tokyo, Japan

[21] Appl. No.: 08/790,379

[22] Filed: Jan. 28, 1997

[30] Foreign Application Priority Data

Jan. 30, 1996 [JP] Japan ..... 8-014078

[51] Int. Cl.[6] ..... G07D 1/00

[52] U.S. Cl. ..... 453/57

[58] Field of Search ..... 453/13, 33, 34, 453/35, 49, 57

[56] References Cited

FOREIGN PATENT DOCUMENTS

| | | | |
|---|---|---|---|
| 5-22276 | 3/1993 | Japan . | |
| 7-114658 | 5/1995 | Japan . | |
| 2185341 | 7/1987 | United Kingdom | 453/57 |

*Primary Examiner*—F. J. Bartuska

*Attorney, Agent, or Firm*—Rohm & Monsanto, PLC

[57] ABSTRACT

A simplified coin dispenser for a gaming machine prevents jamming of coins when paying them out. The coin dispenser is provided with a bucket for accommodating a plurality of coins used as game media in the gaming machine. A rotary disk and associated rotary drive for rotating same are provided at the bottom of the bucket. The rotary disk has a plurality of openings that are disposed side-by-side along the circumference thereof, each of the openings being dimensioned to permit a coin to enter therein. A coin-feeding guide plate and a coin receiving plate are disposed under the rotary disk so as to be rotated synchronously with the rotary disk. The coin-feeding guide plate has a plurality of extension portions for inclining and moving the coins that have entered the openings from the bucket. The coins are received by coin receiving plate, a portion of each of the coins being put onto the extension portion, and the coins are guided in a direction substantially radially away from the center of the rotary disk in response to the rotation of the rotary disk. The coins then are ejected via a coin outlet.

5 Claims, 11 Drawing Sheets

COIN DISPENSER

BACKGROUND OF THE INVENTION

1. Field of the Invention

This invention relates generally to coin dispensers of the type employed in gaming machines, such as slot machines that use coins and/or game media, such as medals, tokens, and the like.

2. Description of the Related Art

Conventionally, a coin dispenser for a gaming machine is provided with a bucket for accommodating a large number of coins therein, a coin feeding portion for feeding the coins with respective identical surfaces turned up, one-by-one from the bucket, and a base that supports the bucket and the coin feeding portion.

FIG. 11 is a partially fragmented plan representation of a prior art hopper apparatus having a body 1, disclosed in Japanese Laid-Open Number 7-114658 as a conventional coin dispenser. A rotary disk 3 is rotatably provided on the surface of a support plate 2 mounted on a base (not shown). Rotary disk 3 is driven into rotation by an electric motor (not shown). The rotary disk is made of synthetic resin, and is formed, in this implementation, with about five to ten circular openings 4 arranged at predetermined intervals along the circumference of rotary disk 3. Each of the circular openings is slightly larger than the diameter of a coin C.

The underside of rotary disk 3 is provided with a coin-feeding guide plate 5 secured thereto so as to rotate synchronously therewith. The coin-feeding guide plate is formed in the shape of a ratchet wheel, and is provided with guide pawls 5*a*. The number of guide pawls is the same as the number of circular openings 4 in rotary disk 3. As shown in FIG. 11, coins C enter circular openings 4 and are supported on support plate 2. Then, the coins are held by guide pawls 5*a* and are urged in the direction away from the center of rotary disk 3, synchronously with the rotation of rotary disk 3.

Rotary disk 3 is installed on support plate 2 with the use of a jig (not shown), or the like. During installation, it is necessary to maintain a gap between rotary disk 3 and support plate 2 so as to be able to eject the coins one-by-one.

On support plate 2, there is installed an outer guide plate 6 that is slightly thicker than coin C. The plates are covered with a cover (not shown). Outer guide plate 6 is formed of a rectangular metallic plate, and is provided with a circular opening 7 at the center thereof. Opening 7 has a diameter that is smaller than that of rotary disk 3 and larger than the outer diameter of coin-feeding guide plate 5 at guide pawl 5*a*. A circumference of opening 7 is formed as a coin guide plane 8.

Further with respect to FIG. 11, at the left side of outer guide plate 6 on support plate 2, a coin outlet 9 is formed having a width such that the coins can pass therethrough one-by-one. A fixed roller 10 and a displaceable roller 11 are disposed at both sides of coin outlet 9. Coin outlet 9 and roller 10 and 11 are arranged as a coin ejecting portion for ejecting the coins that have come to a position facing coin outlet 9.

At a position heading for coin outlet 9 in circular opening 7, a guide projection 12 is provided and arranged to project out of a corresponding support hole (not specifically designated) in support plate 2, for supporting a ball (sphere) that is urged by a spring (not shown) so as to adjoin the underside of rotary disk 3. In operation, guide projection 12 catches a coin C that comes to the position facing coin outlet 9 with the ball, and then guides the coin toward coin outlet 9.

When assembling the coin dispenser as described above, the gap between rotary disk 3 and support plate 2 is adjusted with a jig or the like as it is important to avoid irregularity or non-uniformity of the gap. Rotary disk 3 is made of flexible material such as synthetic resin to facilitate manufacture the coin dispensers in production quantities and reduce the cost of manufacture. When there is a large number of coins on rotary disk 3 and the load on the disk is correspondingly increased, rotary disk 3 becomes distorted and the dimension of the gap is caused to vary. Thus, the coins may become lodged under rotary disk 3, particularly between coin-feeding guide plate 5 and support plate 2, whereupon the arrangement easily becomes jammed.

In addition, when two coins enter opening 7 in a stacked condition, or when a coin has not moved toward coin guide plane 8 for some cause even though rotary disk 3 rotates, the coin will not go toward coin outlet 9, and may pass by the position facing coin outlet 9 in continued motion with rotary disk 3. That is, the coin is not ejected from the dispenser. Therefore, in order to prevent such malfunction, guide projection 12 is provided for catching any coin that has come to the position facing coin outlet 9, and directs the coin toward coin outlet 9 as previously mentioned. This correction to the problems with the known arrangement, however, requires additional parts such as a ball, a spring, etc., and accordingly, the known coin dispenser becomes complicated, expensive, and unreliable.

SUMMARY OF THE INVENTION

1. Objects of the Invention

It is, therefore, an object of the present invention to provide a coin dispenser for a gaming machine wherein jamming of the coins when paying them out, and other similar problems, are prevented.

It is also an object of this invention to produce a reliable arrangement for dispensing coins that is simpler than the known arrangements.

2. Summary of the Invention

In accordance with the invention, a coin dispenser is provided with a bucket for accommodating a plurality of coins that function as game media in the gaming machine. A rotary disk is provided at the bottom of the bucket, and a drive arrangement urges the rotary disk into rotation. A plurality of openings are disposed side-by-side along a circumference of the rotary disk, each of the openings being dimensioned to permit the coins in the bucket to enter therein. A coin receiving plate receives the coins that have entered the openings from the bucket. A coin-feeding guide plate is disposed beneath the rotary disk and arranged to rotate synchronously therewith. The coin-feeding guide plate guides the coins received at the coin receiving plate radially away from a center of the rotary disk, in response to the rotation thereof. Coin ejection means ejects the coins guided by the coin-feeding guide plate. The coin-feeding guide plate is provided with a plurality of extension portions that function as radially transverse inclines whereby the coins that entered the openings of the rotary disk are moved in a direction away from the center of the rotary disk.

When the rotary disk is rotated, the coin receiving plate is rotated synchronously therewith. During such rotation, the coins in the bucket enter the openings and are captured by the coin receiving plate. They are then moved in the direction of rotation of the rotary disk by the coin-feeding guide plate rotating together with the rotary disk, and are urged substantially radially away from the center of the rotary disk. Since the coins are urged away from the center of the rotary disk by the extension portions of the coin-feeding guide plate, when the coins have been translated to a position in the vicinity of the coin ejection means, the coins are expelled from the rotary disk and subsequently are ejected by the coin ejection means.

The coin-feeding guide plate rotates synchronously with the rotary disk, the coins in the openings being urged radially outward by operation of the radially inclined extension portions. A gap is maintained that is substantially equal to the thickness of a coin at the underside of the rotary disk. Then, the coin-feeding guide plate, by operation of the radially inclined extension portions, reliably urges the coins in the direction away from the rotary disk at the coin ejection means or in the vicinity thereof. Thus, the coins that entered the openings of the rotary disk are smoothly ejected without being caught or becoming jammed under the rotary disk.

In addition, the present invention obviates the need to provide means such as the guide projection for catching the coin that has come to the position facing the coin outlet and directing the coin toward the coin outlet, as described in the above-mentioned conventional coin dispenser. Thus, the arrangement of the coin dispenser of the present invention is simple and reliable.

In one embodiment of the invention, the coin-feeding guide plate is formed in the shape of a ratchet wheel and is provided with a plurality of guide pawls, the number of which corresponds to the number of openings of the rotary disk. Each of the guide pawls, in a specific illustrative embodiment of the invention, has a curved shape. In a specific illustrative embodiment of the invention, an inner edge of the curved shape thereof is formed as a coin-holding guide surface that is configured to be substantially congruent with a shape of each of the openings of the rotary disk. A side edge thereof that continues to an outer edge of a succeeding guide pawl is formed as the extension. In this manner, each of the coins that enter the openings of the rotary disk is disposed in part on each of the extension portions to be inclined, thereby the coins are moved in the direction away from the center of the rotary disk.

In addition to the foregoing, each of the openings is configured to have an elliptic shape in the direction of a radius of the rotary disk, and additionally provides an interior surface that provides a side that is inclined with respect to the major axis of the elliptic shape within each of the openings.

Generally, the shape of each of the openings arranged in the rotary disk may be a circle that is larger than a coin, as shown in FIG. 11. However, in conventional arrangements, when numerous coins are piled upon each of the openings via the hopper, the coins have difficulty entering the openings, or the coins that have entered the openings may be oriented upright (i.e., on their edge). Thus, the coins may become jammed with respect to the rotating disk. Therefore, in accordance with the invention, the coins are positioned on the rotating disk in a manner that they might easily enter the openings, by forming each such opening so as to have an elliptic, rather than circular, shape that is elongated in the radial direction of the rotary disk. This provides a side surface in each of the openings that is inclined with respect to the major axis of the elliptic shape. Furthermore, since the coins that enter the openings first come into contact with the above-mentioned inclined side, the coins are urged into an inclined orientation with respect to the openings, thereby preventing the coins from standing on their edges and becoming jammed, as in the conventional arrangements.

BRIEF DESCRIPTION OF THE DRAWING

The foregoing and other objects, features, and advantages of the invention will become more apparent from the following detailed description, taken in conjunction with the accompanying drawings, in which.

DETAILED DESCRIPTION

Figure 1:
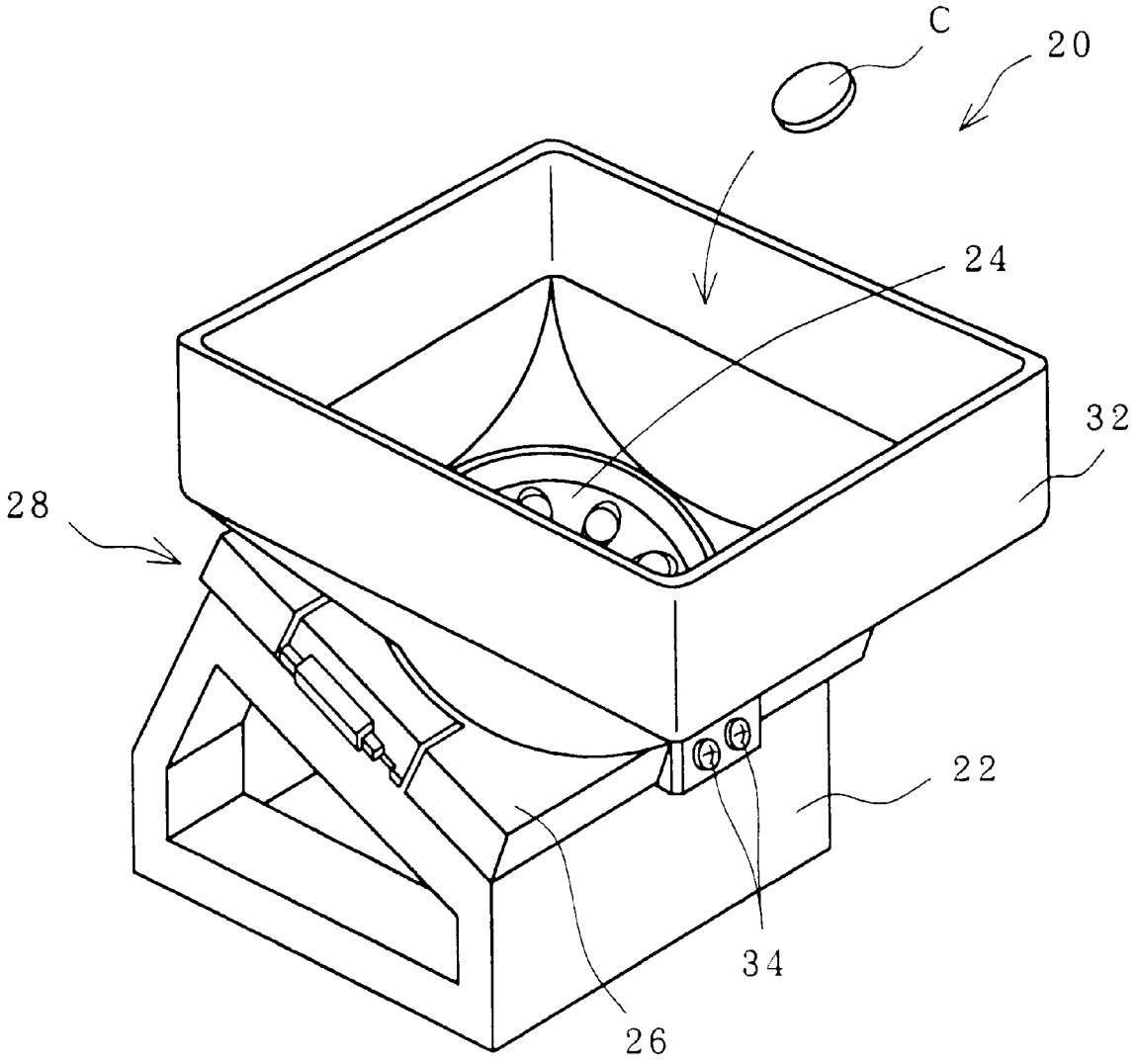
FIG. 1 is an isometric representation of a coin dispenser in accordance with a specific illustrative embodiment of the invention.

FIG. 1 is an isometric representation of a coin dispenser 20 constructed in accordance with a specific illustrative embodiment of the invention. Coin dispenser 20 is provided with a body 28 that includes a base 22, a rotary disk 24, and a cover 26 therein. A bucket 32 is installed on cover 26 for accommodating a large number of coins C therein. Bucket 32 is disengageably installed with screws 34 on cover 26 of body 28.

Figure 2:
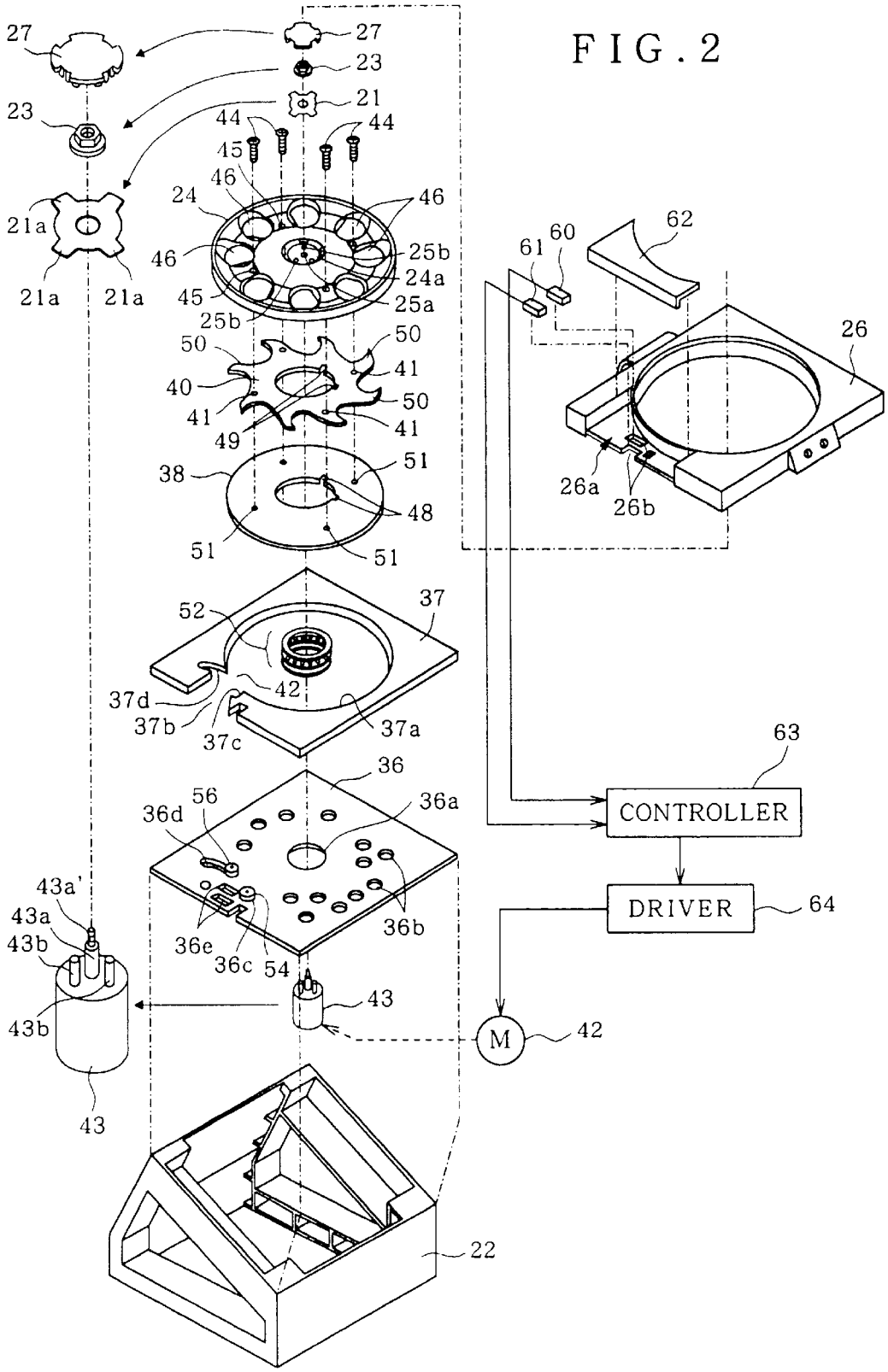
FIG. 2 is an exploded isometric representation of a portion of an arrangement of the coin dispenser of FIG. 1.

FIG. 2 is an exploded isometric representation of body 28 of coin dispenser 20 of FIG. 1, wherein bucket 32 (not shown in this figure) has been removed therefrom. Base 22 consists of a frame wherein the top thereof is formed so as to be slanted at an appropriate angle (e.g., twenty-five degrees in this specific illustrative embodiment of the invention). On the top thereof, a baseplate 36 formed of a metallic plate of rectangular shape is installed aslant thereon.

On the surface of baseplate 36, there is installed an outer guide plate 37. Outer guide plate 37 is formed of a metallic plate of rectangular shape and has a thickness dimension that is slightly larger than that of a coin C (not shown in this figure). Base 22, baseplate 36, and outer guide plate 37 are covered with cover 26. Outer guide plate 37 is provided with a circular opening in the center thereof having a diameter that is smaller than that of rotary disk 24, larger than a coin receiving plate 38, and also larger than the outer diameter of a coin-feeding guide plate 40 (i.e., to the radially outer extent of a guide pawl 50). The circumference of the opening is formed as a coin guide plane 37*a*.

A coin outlet 37*b* having a width that is dimensioned to permit coins (not shown in this figure) to pass therethrough one-by-one is provided at the left side of outer guide plate 37. At an inlet end of coin outlet 37*b*, notches 37*c* and 37*d* are provided for accommodating a fixed roller 54 and a displaceable roller 56 that will be discussed in detail hereinbelow.

Beneath rotary disk 24, i.e., at the underside thereof, a circular coin receiving plate 38 is disposed for receiving the coins (not shown in this figure) that have entered openings 46 of rotary disk 24 from bucket 32 (not shown in this figure), as will be described in greater detail hereinafter. Coin receiving plate 38 rotates synchronously with rotary disk 24 via a coin-feeding guide plate 40 having a ratchet wheel configuration and disposed between coin receiving plate 38 and rotary disk 24.

Figure 7:
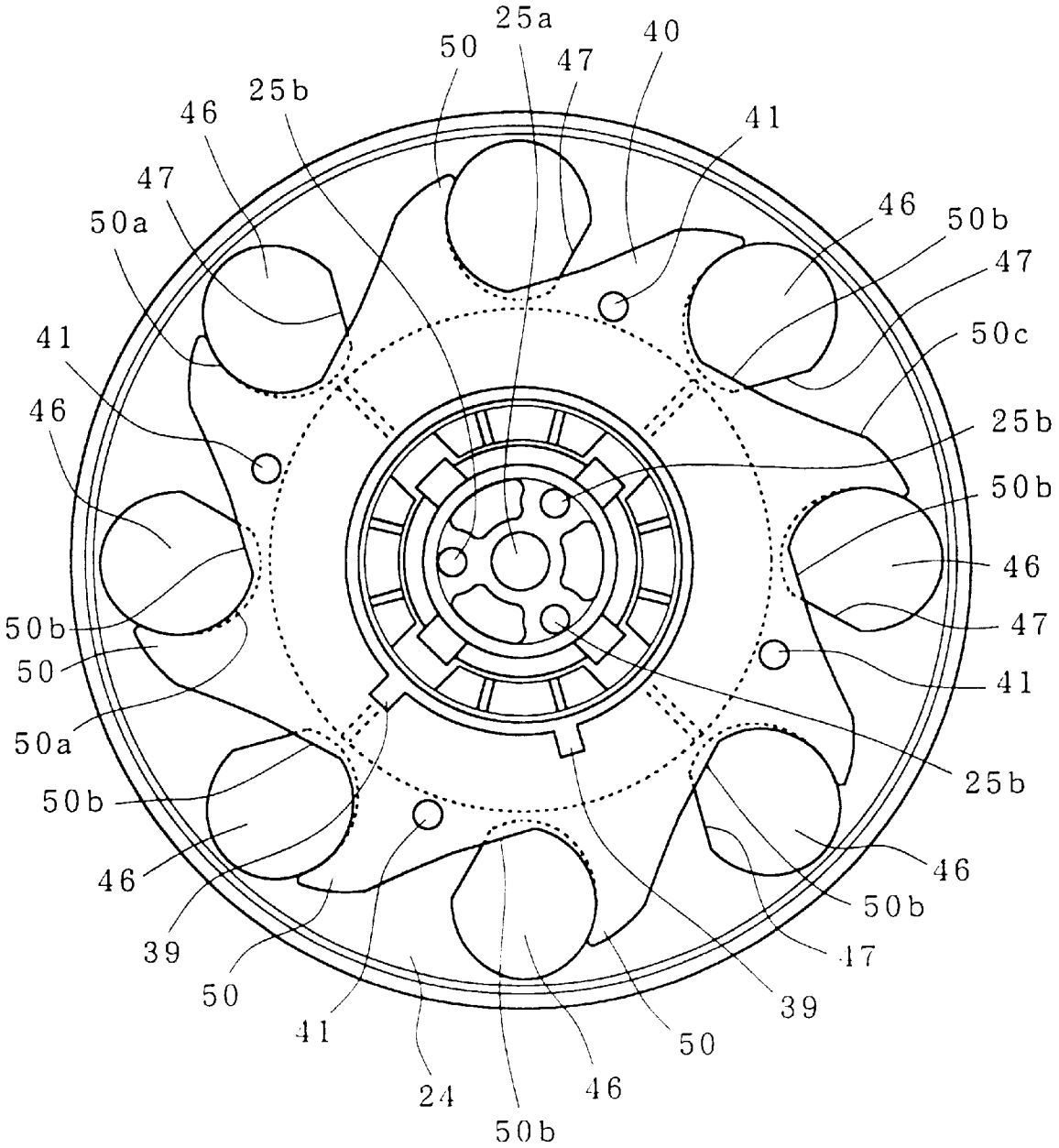
FIG. 7 is a plan representation of the underside of the rotary disk of FIG. 4 installed with the coin-feeding guide plate thereon.
Figure 8:
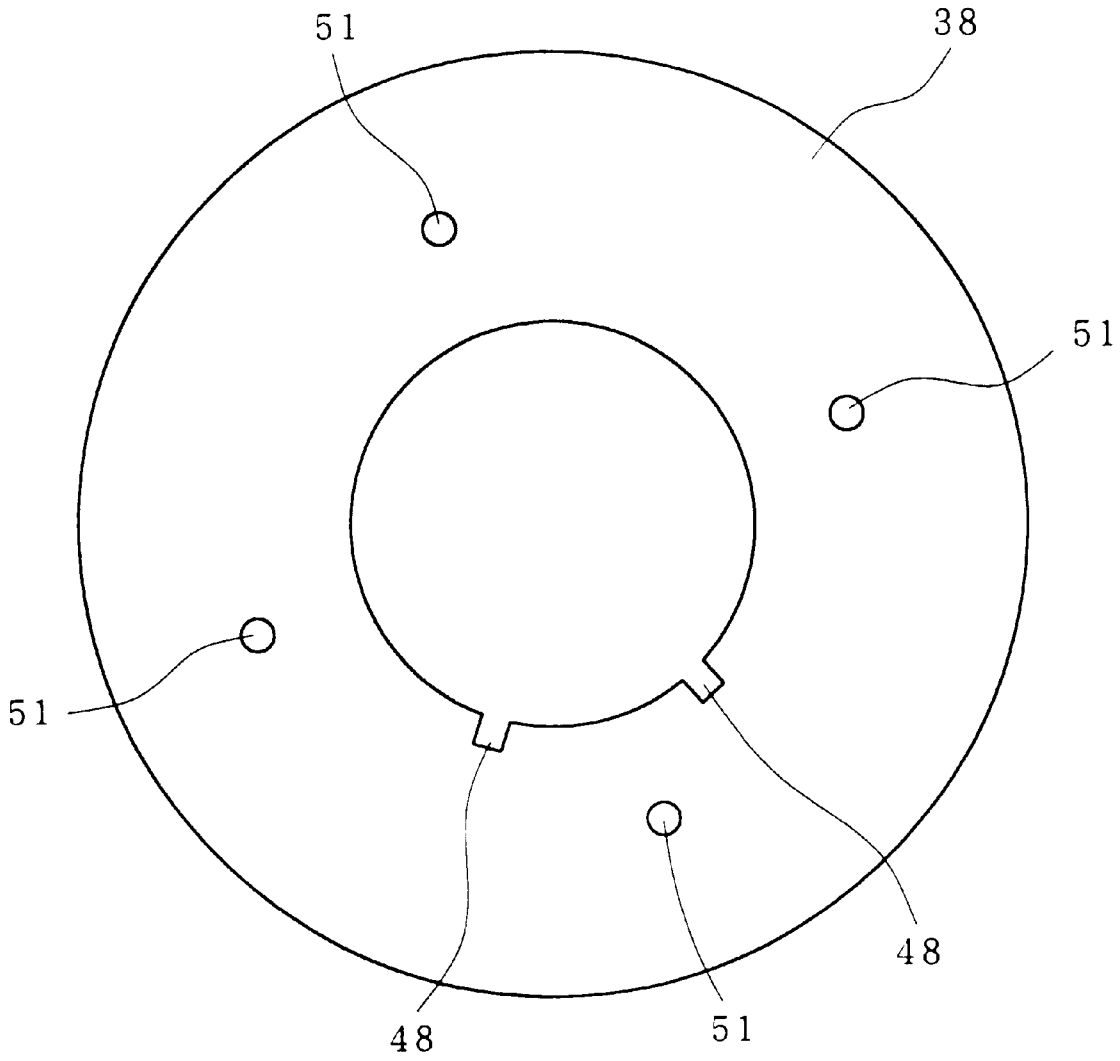
FIG. 8 is a top plan representation of a coin receiving plate of the coin dispenser.

FIG. 8 is a top plan representation of a coin receiving plate of the coin dispenser. As shown in FIG. 8, coin receiving plate 38 is formed of an annular metallic plate and is provided with two notches 48 disposed at an appropriate interval of arc from one another in the circumference of a central opening thereof. Positioning projections 39 (shown in FIG. 7) are arranged on the underside of rotary disk 24 to fit within notches 48. In addition, coin receiving plate 38 is provided with screw holes 51 for accommodating screws 44 (FIG. 2) therethrough at locations that correspond to through holes 41 of coin-feeding guide plate 40.

Referring once again to FIG. 2, coin-feeding guide plate 40, which is interposed between coin receiving plate 38 and rotary disk 24 thereabove, rotates synchronously therewith. The coin-feeding guide plate is provided with a plurality of pawls 50 along the circumference thereof, the pawls 50 having a width that is substantially equal to the thickness of a coin. The coin-feeding guide plate functions to hold the coins (not shown in this figure) that are received by the coin receiving plate 38, at angular intervals defined by adjacent ones of pawls 50. When rotary disk 24 rotates, the coins are urged radially away from the center thereof.

Figure 6:
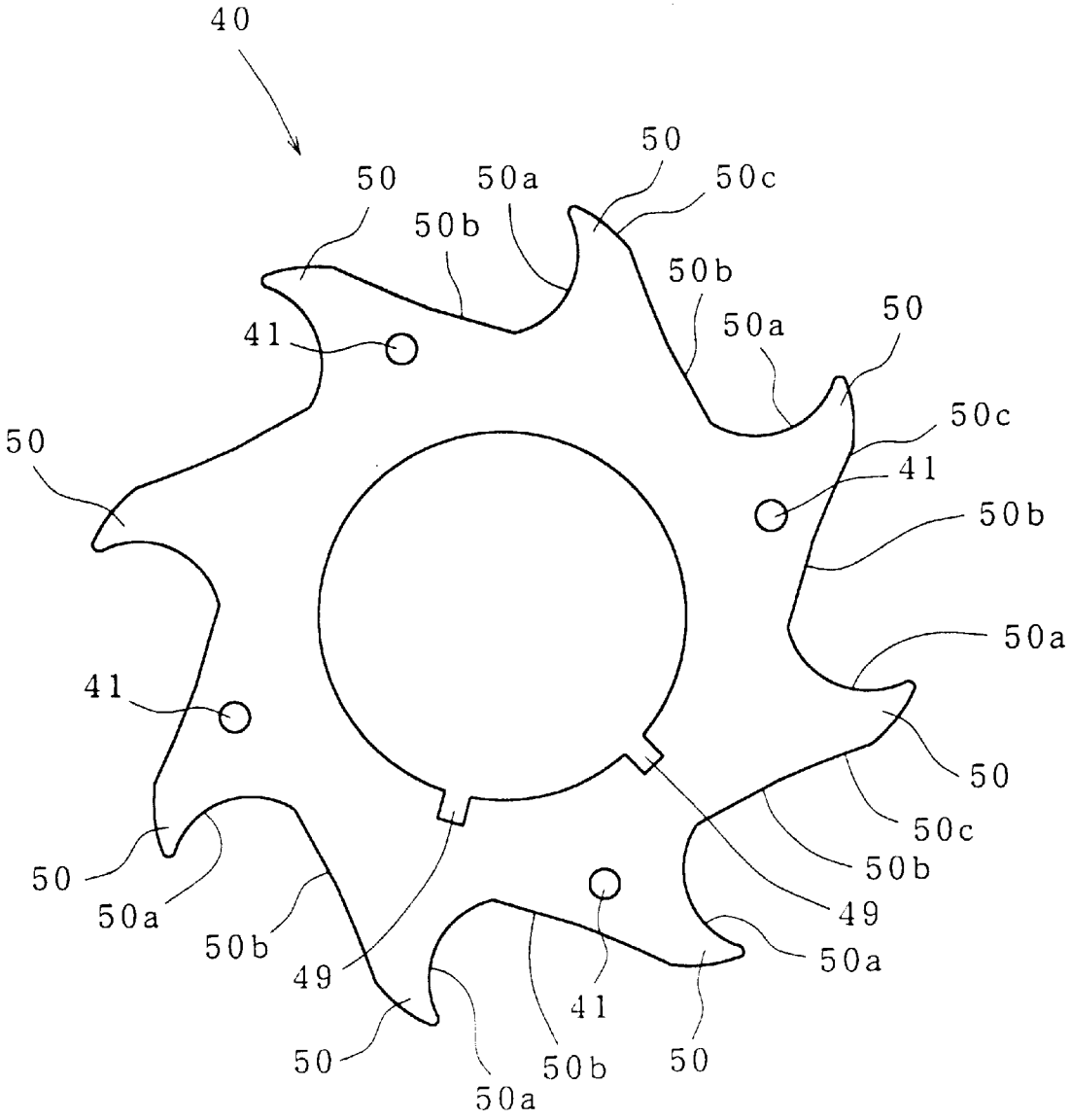
FIG. 6 is a top plan representation of a coin-feeding guide plate employed in the coin dispenser of FIG. 2.

FIG. 6 is a top plan representation of coin-feeding guide plate 40 employed in coin dispenser 20 of FIG. 2. Coin-feeding guide plate 40 is formed of an annular metallic plate and configured to have a ratchet wheel shape, as shown in FIG. 6. As will be discussed in detail hereinbelow, the coin-feeding guide plate is provided with a plurality of guide pawls 50, the number thereof corresponding to the number of openings 46 in rotary disk 24. Coin-feeding guide plate 40 is provided with through holes 41 for accommodating screws 44 therethrough at the positions corresponding to alternate ones of guide pawls 50. In addition, coin-feeding guide plate 40 is provided with two notches 49 at an appropriate interval at the circumference of a central opening thereof, similar to notches 48 of coin receiving plate 38. Positioning projections 39 (shown in FIG. 7) are arranged on the underside of rotary disk 24 to engage with notches 48 and 49.

Figure 3:
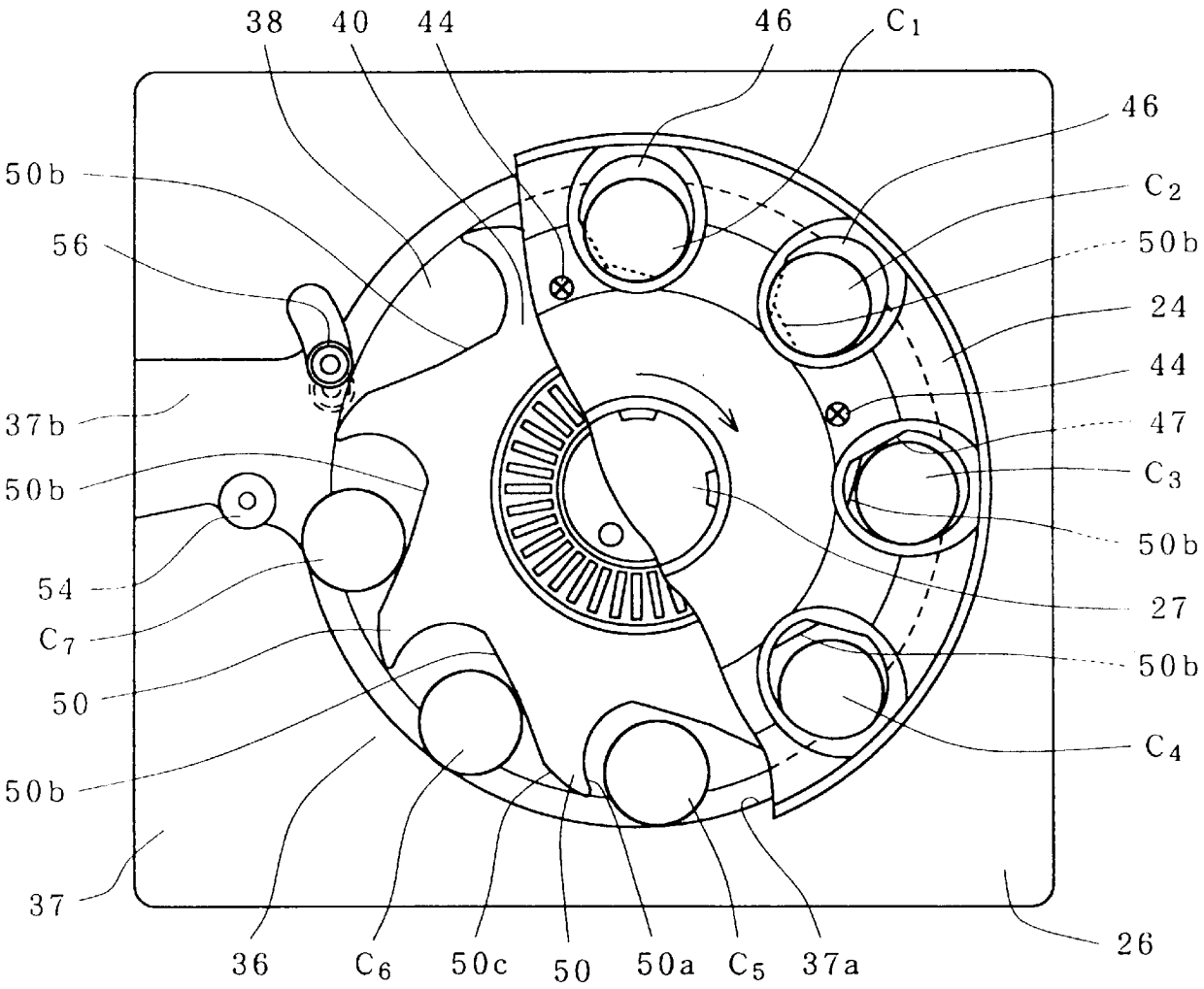
FIG. 3 is a top plan representation of the coin dispenser of FIG. 2 partially broken away.
Figure 9:
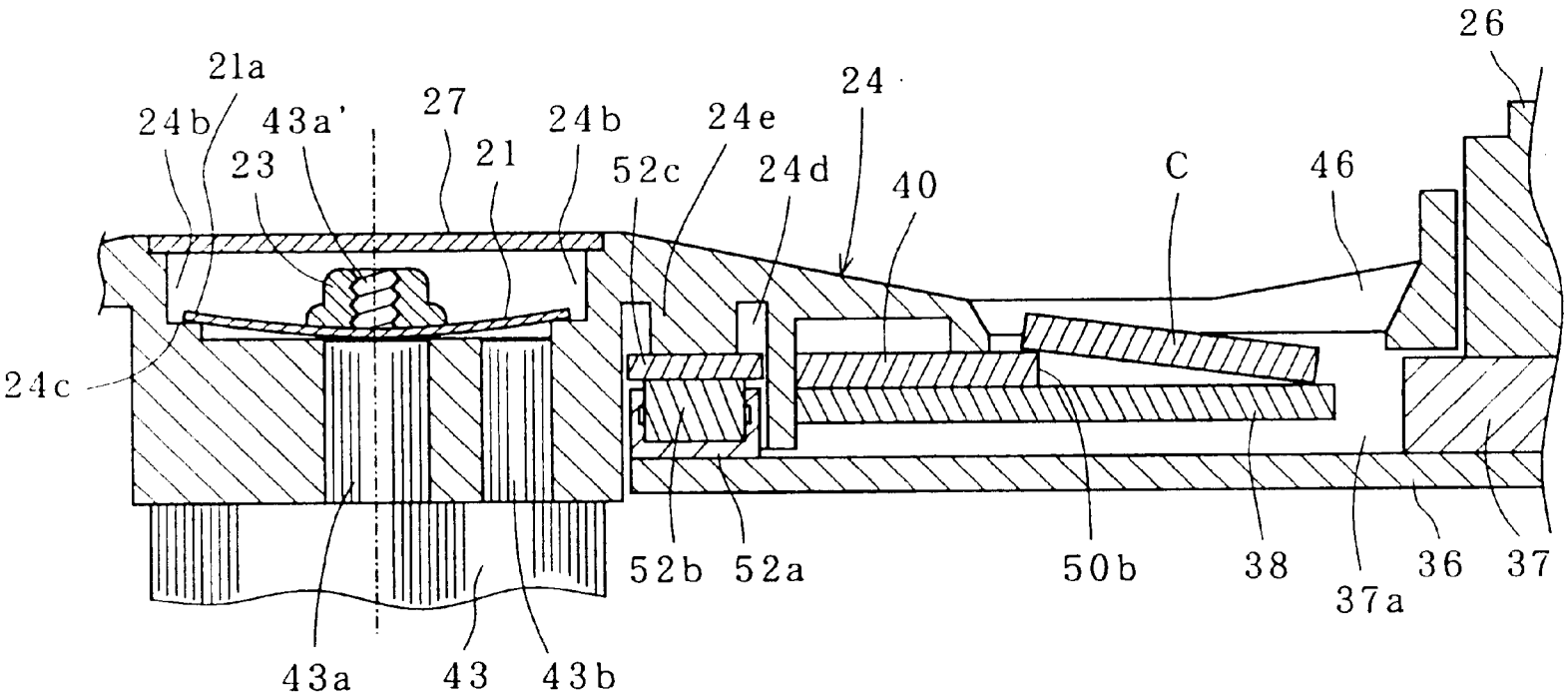
FIG. 9 is an enlarged partially cross-sectional side representation of the specific illustrative embodiment of the invention of FIG. 3 wherein a coin has entered an opening of the rotary disk.

FIG. 9 is an enlarged partially cross-sectional side representation of the specific illustrative embodiment of the invention of FIG. 3 wherein a coin has entered an opening of the rotary disk.

Each of guide pawls 50 of coin-feeding guide plate 40 has a shape that is curved toward the counterclockwise direction, as viewed from above. An inner edge of the curved shape thereof is formed as a coin-holding guide surface 50*a*, and an outer edge thereof is formed as coin-feeding guide surface 50*c*, respectively. Each coin-holding guide surface 50*a* is formed arcuately along each of openings 46 of rotary disk 24. An inner edge of the curved shape (coin-holding guide surface 50*a*) of guide pawl 50 extends counterclockwise to an outer edge (coin-feeding guide surface 50*c*) of a succeeding guide pawl. A side edge that is substantially continuous from coin-holding guide surface 50*a* of each one of guide pawls to coin-feeding guide surface 50*c* of a succeeding guide pawl is formed as extension 50*b*. In this manner, when coin C enters opening 46 of rotary disk 24, the coin is disposed in part on extension 50*b* so as to be inclined in the direction away from the center of the rotary disk. A coin thus inclined in each of the openings can smoothly be ejected at the coin-ejecting position, or in the vicinity thereof, from the underneath of rotary disk 24.

Figure 4:
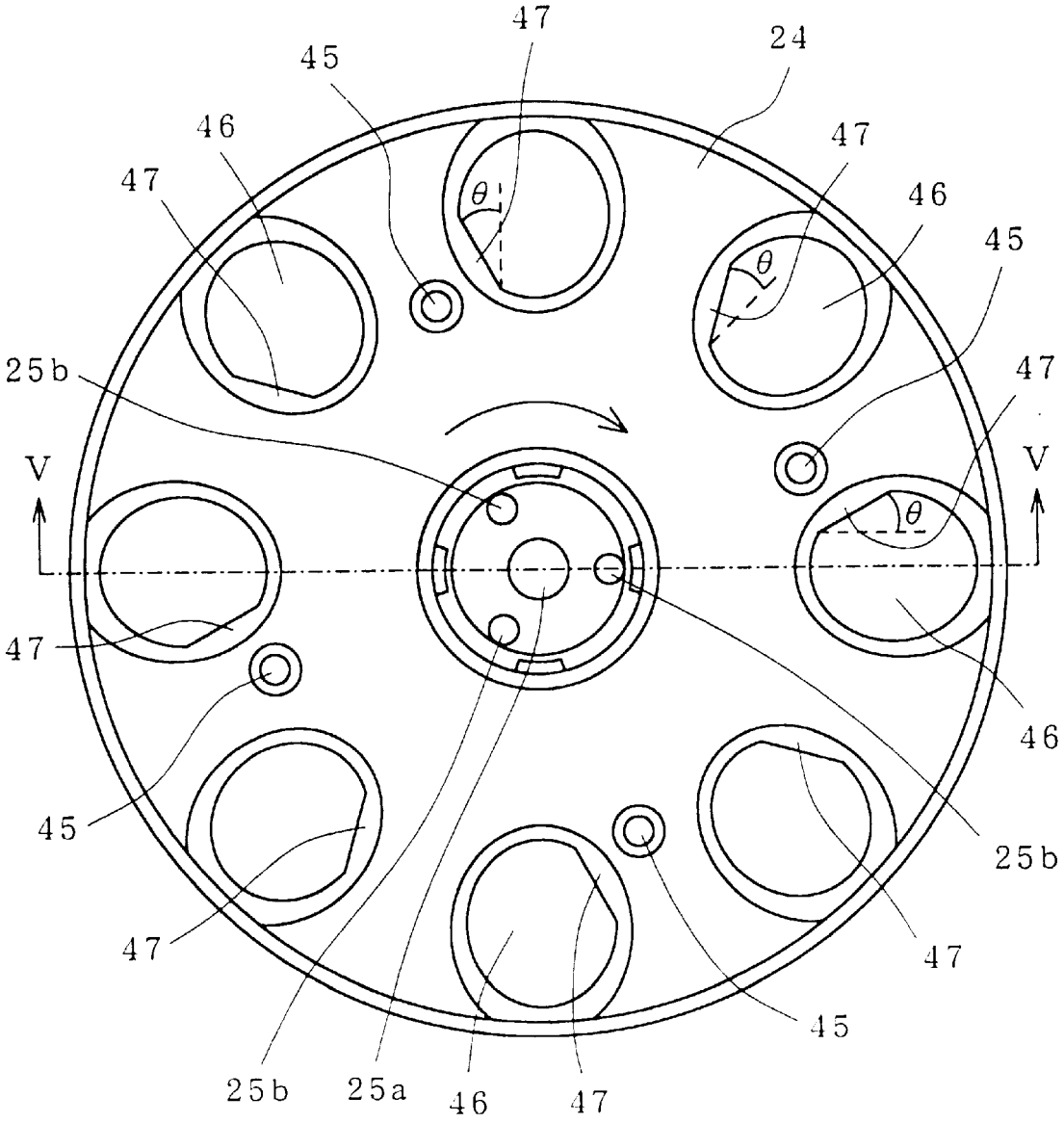
FIG. 4 is a top plan representation of a rotary disk of the coin dispenser.

FIG. 3 is a partially fragmented top plan representation of the coin dispenser of FIG. 2, and FIG. 4 is a top plan representation of rotary disk 24 of the coin dispenser.

In this specific illustrative embodiment of the invention, eight elliptic openings 46 are formed on rotary disk 24, each of the openings having a diameter that is slightly larger than a coin C. In the vicinity of openings 46, there are provided through holes 45 for inserting screws 44 therethrough. As shown in FIGS. 3 and 4, openings 46 are disposed, in this embodiment of the invention, at uniform angular intervals along the circumference of rotary disk 24. In each of openings 46, an inclined side 47 that has a side inclined at a predetermined angular θ (e.g., 27.5° in this specific illustrative embodiment of the invention) with respect to the major axis of the elliptic shape of the openings.

Figure 10:
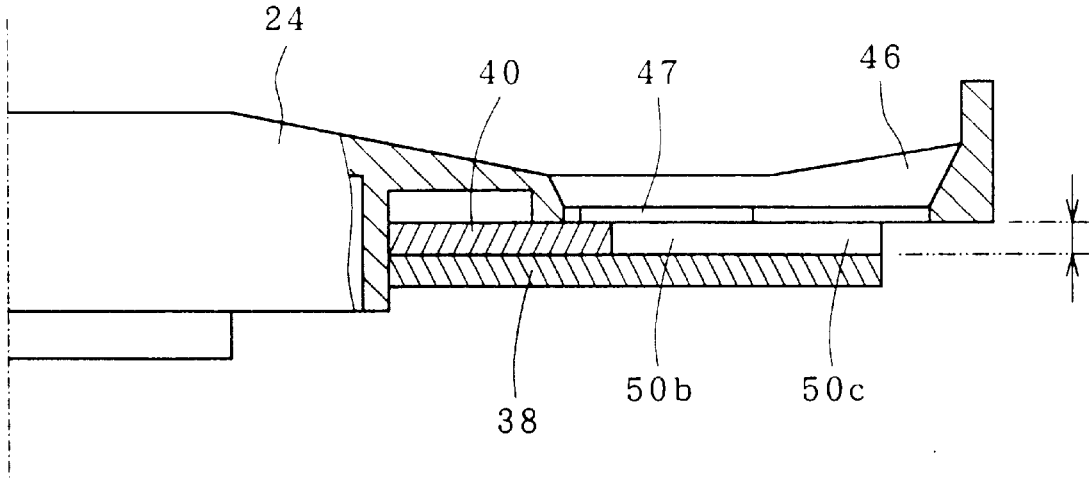
FIG. 10 is an enlarged partially cross-sectional side representation of the specific illustrative embodiment of the invention of FIG. 3 wherein a coin has not entered the opening of the rotary disk.
Figure 11:
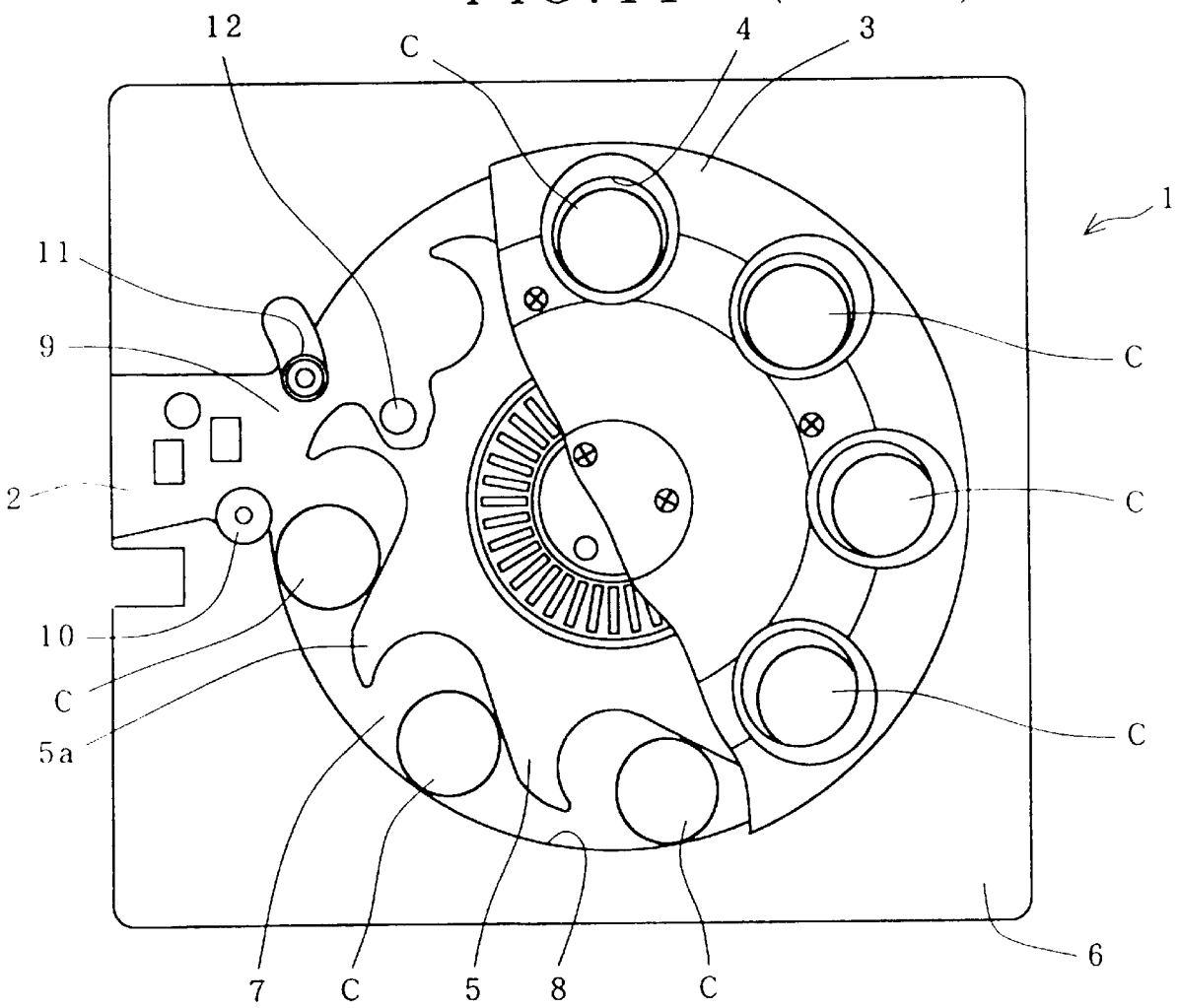
FIG. 11 (PRIOR ART)
FIG. 11 is a partially fragmented top plan representation of a conventional, prior art coin dispenser.

Coins C, positioned upon the rotary disk 24, easily enter openings 46 by virtue of the openings having elliptic shapes configured on rotary disk 24 and an associated inclined side 47 within each of such openings, as shown in FIG. 10. Furthermore, since the coin is partially disposed on inclined side 47, as will be described in detail hereinafter, the coin is definitely inclined with respect to opening 46. Therefore, the coins are prevented from jamming or achieving a standing orientation (on edge) within openings 46.

Figure 5:
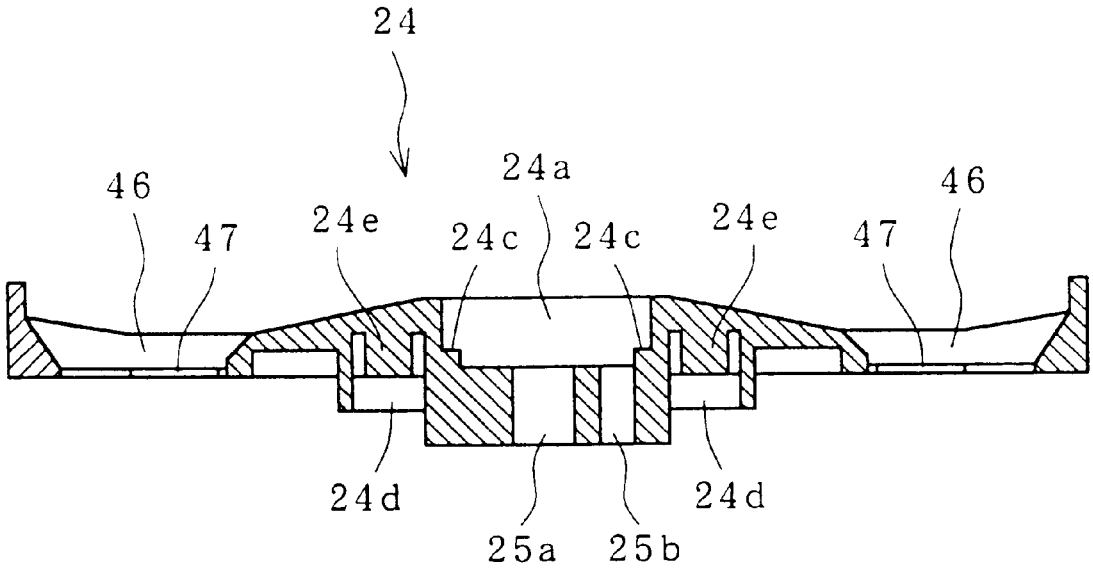
FIG. 5 is a cross-sectional side representation of the rotary disk, taken along line V—V of FIG. 4.

FIG. 5 is a cross-sectional side representation of rotary disk 24, taken along line V—V of FIG. 4. As shown in FIGS. 2 and 5, the center of rotary disk 24 is shown to project downward, and a circular recess 24*a* is arranged inside of the center thereof from above. A hole 25*a* is arranged in the center of rotary disk 24 extending downward from the bottom of recess 24*a*, and three further holes 25*b* (only one of which is shown in this figure) are arranged about long hole 25*a*. As shown in FIGS. 5 and 9, since the upper circumference of each of openings 46 of rotary disk 24 is formed to have a substantially frustoconical inverted shape that widens in the upward direction, coins C can readily enter openings 46.

On the underside of rotary disk 24, an annular installation slot 24*d* is arranged for accommodating a thrust bearing 52, shown in FIG. 2. Within installation slot 24*d*, two annular portions 24*e*, shown in FIGS. 5, and 9, are provided. In thrust bearing 52, a plurality of rollers 52*b* that rotate around respective radial axes are disposed at uniform angular intervals on an annular support disk 52*a*, whereon an annular upper disk 52*c* that is accommodated within installation slot 24*d* of rotary disk 24 is installed. Since thrust bearing 52 is accommodated within installation slots 24*d* of rotary disk 24, thrust bearing 52 is interposed between rotary disk 24 and baseplate 36, and receives the load of the coins in bucket 32 (not shown in these figures) that is positioned on rotary disk 24. Since upper disk 52*c* and support disk 52*a* of thrust bearing 52 are rotatable with one another by means of rollers 52*b* lying between them, rotary disk 24 will rotate smoothly beneath bucket 32.

FIG. 7 is a plan representation of the underside of the rotary disk of FIG. 4 with the coin-feeding guide plate installed thereon. When assembling rotary disk 24, coin-feeding guide plate 40, and coin receiving plate 38, as shown in FIGS. 2 and 7, the elements of structure are superposed in registration with one another so that portions of the circumferences of openings 46 of rotary disk 24 and coin-holding guide surfaces 50*a* of coin-feeding guide plate 40 are coincident with one another, and in addition, two positioning projections 39 arranged on the underside of rotary disk 24 fit with corresponding notches 49 of coin-feeding guide plate 40 and corresponding notches 48 of coin receiving plate 38, respectively. Then, rotary disk 24, coin-feeding guide plate 40, and coin receiving plate 38 are secured to one another by screws 44 that, in this specific illustrative embodiment of the invention, are installed from above via through holes 45 of rotary disk 24 and through holes 41 of coin-feeding guide plate 40, and by engaging such screws with screw holes 51 of coin receiving plate 38.

Referring once again to FIG. 2, beneath baseplate 36 there is provided an electric motor 42 (shown schematically) having a deceleration mechanism (not specifically identified). A head 43 having a column shape is secured at an output shaft of the deceleration mechanism, which is positioned within shaft hole 36*a* of baseplate 36. Head 43 has a disk-securing pin 43*a* that is arranged to project from the center of the upper edge of a circular shape thereof, and three positioning pins 43*b* around disk-securing pin 43*a*. An upper edge of disk-securing pin 43*a* is arranged as a screw portion 43*a*' for securing a nut 23 having a flange as will be described in detail later. Disk-securing pin 43*a* penetrates through central long hole 25*a* of rotary disk 24 upward, and has a length that is predetermined to permit screw portion 43*a*' to project upward. Three positioning pins 43*b* are inserted into three holes 25*b* that are arranged around central hole 25*a* of rotary disk 24, and each has a length that corresponds to the axial thickness of the center of rotary disk 24, whereby the positioning pins extend to, or slightly below, the bottom of recess 24*a*.

Rotary disk 24, positioned upon head 43, is attached with elastic plate 21 having a substantially crosswise shape at the bottom of recess 24*a* of the center of the rotary disk, and nut 23 having a flange is put into screw portion 43*a*' of disk-securing pin 43*a* that penetrates through hole 25*a* upward from below to project above elastic plate 21. Thus, rotary disk 24 is secured as shown in FIG. 9, holding elastic plate 21 between disk-securing pin 43*a* of head 43 and nut 23. In addition, recess 24*a* of rotary disk 24 is covered with a cover 27, shown in FIG. 2.

Elastic plate 21 is formed of a circularly configured metallic plate that has four projections 21*a* extending outward in four directions, as shown in a partially enlarged representation of FIG. 2. When elastic plate 21 is attached within recess 24*a* of rotary disk 24, the four projections are accommodated in receiving portions 24*b* formed at a side wall of recess 24*a*, as shown in FIG. 9. As shown in FIG. 9, at each of receiving portions 24*b* within recess 24*a* of rotary disk 24, while projecting portions 21*a* of elastic plate 21 are disposed on stepped portions 24*c* that are formed slightly higher than the bottom of the recess. Nut 23 has a flange portion (not specifically identified) such that when the nut is screwed onto disk-securing pin 43*a* of head 43, the four projecting portions of elastic plate 21 are bent upward, as shown.

Thus, rotary disk 24, coin-feeding guide plate 40, and coin receiving plate 38 form a unitary assembly and are driven into rotation as a unit via head 43 by means of the deceleration mechanism (not shown) with electric motor 42 providing the motive power. Thus, in the event a force is applied that would cause rotating disk 24 to be inclined, illustratively as a result of the weight of the coins positioned thereon, the force is diminished by elastic plate 21. That is, elastic plate 21 elastically deforms and mitigates the force. Therefore, rotary disk 24 can stably be rotated.

On baseplate 36, besides shaft hole 36*a*, there are provided a plurality of holes 36*b* for ejecting dust, a shaft hole 36*c* for fixed roller 54 and an elongated slot 36*d* for accommodating displaceable roller 56 at both sides of coin outlet 37*b* on baseplate 36, and a pair of detection windows 36*e* for respective ones of coin sensors 60 and 61 that detect the coins that are ejected, as will be described hereinafter.

On the surface of baseplate 36, fixed roller 54 and displaceable roller 56 are installed in the vicinity of the inlet side of coin outlet 37*b*, and function as the coin ejecting portion for ejecting the coins that have come to coin outlet 37*b*.

In detail, fixed roller 54 is rotatably disposed at a fixed position by a shaft (not shown) that extends through shaft hole 36*c* arranged on baseplate 36. Displaceable roller 56 is disposed so that its position is changeable in response to the movement of the shaft that rotatably supports the roller along elongated slot 36*d* of baseplate 36. Since coins C communicate with the circumferential side of displaceable roller 56 and are energetically fed to coin outlet 37*b*, the circumferential side of displaceable roller 56 is covered with an elastic member such as rubber, synthetic resin, or the like.

The shaft of displaceable roller 56 can be displaced between an outlet-closing position of an end of elongated slot 36*d* and an outlet-opening position of the other end thereof. However, the shaft is ordinarily urged by the spring (not shown) toward the closing position shown in FIG. 3. In the closing position, displaceable roller 56 enters the vicinity of the outer circumferences of coin-feeding guide plate 40 and of coin receiving plate 38. In response to rotation of coin-feeding guide plate 40 and coin receiving plate 38, the coin that has come to the coin outlet 37*b* abuts on displaceable roller 56 in the closing position, and displaces displaceable roller 56 in the above direction of FIG. 3. Then, coin C is urged from the position between displaceable roller 56 and fixed roller 54 toward the outlet end of coin outlet 37*b* by the torque of displaceable roller 56 displaced in the outlet-opening position. Coin C is then energetically ejected from coin outlet 37*b*.

As shown in FIG. 2, detection of the coins ejected as described above is achieved, in this embodiment, by two coin sensors 60 and 61 that are disposed in recesses 26*a* of cover 26. A shading lid 62 is additionally installed thereon. On cover 26 and baseplate 36, detection windows 26*b* and 36*e* are arranged at positions corresponding to coin sensors 60 and 61. As coin sensors 60 and 61, photosensors of the reflection or transparent type are employed. The sensors generate a detection pulse and deliver the pulse to controller 63 each time an ejected coin passes therethrough.

Controller 63 consists of a microcomputer, and controls the operation of the gaming machine. Electric motor 42 is connected thereto via an electric motor drive circuit 64. Controller 63 delivers a drive control signal to drive circuit 64 for driving electric motor 42 in order to pay out the coins of the number corresponding to a predetermined state, or condition, of the game. Then, controller 63 drives rotary disk 24, coin-feeding guide plate 40, and coin receiving plate 38 into rotation via head 43 by operation of the motor. Thus, the coins are ejected one-by-one via coin outlet 37*b*. The ejected coins are detected by coin sensors 60 and 61, and the number of coins that are paid out is calculated by controller 63 in response to a detection signal therefrom. When the number of coins reaches the predetermined number, controller 63 inhibits driving of electric motor 42.

The following describes the operation of coin dispenser 20. If a large number of coins C are present in bucket 32 of FIG. 1, when the coins of the predetermined number corresponding to the state of the game are paid out, controller 63 of FIG. 2 delivers a drive control signal to drive circuit 64 for driving electric motor 42. Rotary disk 24 is rotated clockwise in this embodiment together with coin-feeding guide plate 40 and coin receiving plate 38 via head 43 in FIG. 3. Even if a significant load is present in the axial direction of rotary disk 24 resulting from the presence of a large number of coins C, the load is supported by thrust bearing 52, and rotary disk 24 rotates smoothly.

With respect to FIG. 3, when coin $C_1$ falls into opening 46 of rotary disk 24, it is supported by coin receiving plate 38. Coin $C_1$ is put on inclined side 47 of opening 46 to be inclined. A gap is maintained between the lower side of rotary disk 24 and the upper side of coin receiving plate 38, having substantially the same thickness as a coin C by coin-feeding guide plate 40.

After the coin passes through opening 46 and is received on coin receiving plate 38, it is urged in the direction radially away from the center of rotary disk 24 in response to the rotation of rotary disk 24, and is concurrently carried in the direction of the rotation of rotary disk 24 along coin guide plane 37*a* that consists of the circumference of circular opening of outer guide plate 37. Thus, a portion of the coin that is put on inclined side 47 within opening 46, as is shown as coin $C_2$ of FIG. 3, is moved onto extension 50*b* of coin-feeding guide plate 40 to be inclined (FIG. 9). In response to the rotation of rotary disk 24, the coin departs from extension 50*b*, as is shown as coin $C_3$, and it passes under the opening portion formed by inclined side 47, extension 50*b*, and opening 46, whereby, the coin is put upon coin receiving plate 38, as is shown as coin $C_4$. Furthermore, in response to the rotation of rotary disk 24, the coin moves abutting on coin-feeding guide surface 50*c* of coin-feeding guide plate 40, as is shown as coins $C_5$ to $C_7$.

Coin C then abuts against fixed roller 54 in the vicinity of the inlet of coin outlet 37*b*, and is urged by coin-feeding guide surface 50*c* of coin-feeding guide plate 40 to displace displaceable roller 56 in the opening direction. When coin C goes over displaceable roller 56 at the position where an end of guide pawl 50 abuts on coin C, coin C is energetically ejected by a torque force applied by displaceable roller 56 via coin outlet 37*b*. When the number of coins ejected as above reaches the predetermined number to be paid out, controller 63 inhibits electric motor 42, and stops ejection of the coins.

In the above-mentioned embodiment, the receipt of the coins by rotary disk 24 is improved by integration of rotary disk 24, coin-feeding guide plate 40, and coin receiving plate 38. Even though there may be present a large number of coins on rotary disk 24, the rotary disk rotates easily and is not warped, while the gap between rotary disk 24 and coin receiving plate 38 is maintained by coin-feeding guide plate 40. Therefore, jamming of the coins or the entry of foreign objects will not occur.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A coin dispenser arrangement for a gaming machine, comprising:

a bucket for containing a plurality of coins used as game media in the gaming machine;

a rotary disk arranged beneath said bucket and having a plurality of openings arranged sequentially and circumferentially therein, each of the openings being dimensioned to receive at least one of the coins from the bucket, said rotary disk being rotatable about an axis of rotation;

drive means for driving the rotary disk rotatively;

a coin receiving plate for receiving ones of the coins that have entered the openings in said rotary disk from the bucket;

a coin-feeding guide plate disposed intermediate of said rotary disk and said coin receiving plate, said coin-feeding guide plate having an upper surface directed toward said rotary disk and being arranged to rotate synchronously with said rotary disk and with said coin receiving plate, for guiding the ones of the coins received by said coin receiving plate in a direction substantially radially away from the center of said rotary disk, in response to the rotation thereof; and coin ejection means for ejecting the ones of the coins guided by said coin-feeding guide plate;

wherein said coin-feeding guide plate has a plurality of extension portions extending to the coin receiving surface of the coin receiving plate for causing the at least one of the coins received from the bucket to become oriented as inclined toward said coin receiving plate in a direction of inclination away from the axis of rotation immediately after the received coin has entered one of said plurality of openings in said rotary disk, the coin in the inclined orientation being partially disposed on the upper surface of the extension portion of the coin-feeding guide so as to be urged substantially radially away from the axis of rotation of said rotary disk.

2. The coin dispenser of claim 1, wherein said coin-feeding guide plate is formed in a ratchet wheel shape that has a plurality of guide pawls, the number of which corresponding to that of the openings of said rotary disk, each of the guide pawls having a curved shape and an inner edge of a curved portion thereof formed as a coin-holding guide surface to be coincident with a shape of each of the openings of said rotary disk, and a side edge extending from the coin-holding guide surface to an outer edge of a succeeding one of guide pawls is formed as an extension portion extending to the coin receiving surface of the coin receiving plate for supporting the received coin in the inclined orientation.

3. The coin dispenser of claim 1, wherein said opening of said rotary disk has an elliptic shape to form an elliptic opening that is longer in the radial direction of said rotary disk, the elliptic opening having an interior surface, a portion of the interior surface of the elliptic opening being configured to be substantially planar and to project inwardly toward the elliptic opening to form an inclined side that is inclined with respect to a major axis of the elliptic opening.

4. The coin dispenser arrangement of claim 1, wherein there is further provided an elastic plate attached to said rotary disk for resiliently mitigating, by elastic deformation, a force applied to said rotary disk resulting from the weight of the plurality of coins contained in the bucket.

5. The coin dispenser arrangement of claim 1, wherein there is further provided:

a stationary base plate positioned under said coin receiving plate; and a thrust bearing interposed between said rotary disk and said stationary base plate, said thrust bearing receiving a force resulting from the weight of the plurality of coins contained in the bucket.

* * * * *